US012637869B1

(12) United States Patent
Wong

(10) Patent No.: US 12,637,869 B1
(45) Date of Patent: May 26, 2026

(54) ALIGNMENT AND CONNECTION SYSTEM FOR PREFABRICATED MODULAR BUILDINGS

(71) Applicant: Cloud Apartments, Inc., Berkeley, CA (US)

(72) Inventor: Curtis Harrison Wong, Berkeley, CA (US)

(73) Assignee: Cloud Apartments, Inc., Richmond, CA (US)

( * ) Notice: Subject to any disclaimer, the term of this patent is extended or adjusted under 35 U.S.C. 154(b) by 769 days.

(21) Appl. No.: 18/070,115

(22) Filed: Nov. 28, 2022

Related U.S. Application Data

(60) Provisional application No. 63/288,626, filed on Dec. 12, 2021.

(51) Int. Cl.
*E04H 1/00* (2006.01)
*E04H 1/02* (2006.01)
*E04H 1/12* (2006.01)

(52) U.S. Cl.
CPC ..... *E04H 1/005* (2013.01); *E04H 1/02* (2013.01); *E04H 2001/1283* (2013.01)

(58) Field of Classification Search
CPC .. E04H 1/005; E04H 1/02; E04H 1/04; E04H 2001/1283; E04H 3/02
See application file for complete search history.

(56) References Cited

U.S. PATENT DOCUMENTS

| | | | | |
|---|---|---|---|---|
| 3,866,672 | A * | 2/1975 | Rich, Jr | F24F 3/044 165/50 |
| RE28,367 | E * | 3/1975 | Rich, Jr. et al. | E04B 1/348 52/79.8 |
| 6,625,937 | B1 * | 9/2003 | Parker | E04H 1/02 52/79.9 |
| 6,944,998 | B1 * | 9/2005 | King | B44F 9/04 47/33 |
| 9,441,359 | B1 * | 9/2016 | Hsieh | E04B 1/3483 |
| 10,450,737 | B2 * | 10/2019 | Bowron | E04B 1/24 |
| 11,276,323 | B1 * | 3/2022 | Kirchner | E04B 1/34331 |
| 2008/0134589 | A1 * | 6/2008 | Abrams | E04B 1/34807 52/79.1 |
| 2011/0056147 | A1 * | 3/2011 | Beaudet | E04B 1/34869 52/79.9 |

(Continued)

FOREIGN PATENT DOCUMENTS

| | | | | |
|---|---|---|---|---|
| CN | 213026732 U | * | 4/2021 | |
| CN | 118498789 A | * | 8/2024 | E04H 9/021 |

(Continued)

*Primary Examiner* — Ryan D Kwiecinski
(74) *Attorney, Agent, or Firm* — Fenwick & West LLP

(57) ABSTRACT

Disclosed is a modular housing construction system. The system includes a plurality of housing modules configured to stack upon each other to create a multi-story construction assembly. Each housing module may include at least a room section, an optional riser section and a corridor section. The system may include one or more riser alignment elements. The riser alignment elements may include a plurality of pre-installed risers disposed within riser openings. The riser openings being configured to position the risers, relative to the riser alignment element, to within a predefined range each dimension of a horizontal plane.

10 Claims, 11 Drawing Sheets

(56) References Cited

U.S. PATENT DOCUMENTS

2011/0162293 A1* 7/2011 Levy ..... E04B 1/3483 52/79.9
2012/0077429 A1* 3/2012 Wernimont ..... F24F 3/167 52/302.1
2014/0115976 A1* 5/2014 Lippert ..... E04H 1/005 52/79.2
2014/0123573 A1* 5/2014 Farnsworth ..... E04B 1/3483 52/79.9
2014/0298745 A1* 10/2014 Rechenmacher ..... E04H 1/005 52/425
2014/0318036 A1* 10/2014 Eom ..... H01Q 1/1214 52/79.1
2015/0266616 A1* 9/2015 Barrable ..... B65D 90/0006 403/267
2016/0002909 A1* 1/2016 Bowron ..... E04B 1/3483 52/745.03
2016/0017609 A1* 1/2016 Bottin ..... E04H 1/005 52/302.1
2016/0040443 A1* 2/2016 Stephenson ..... E04H 1/005 52/79.5
2016/0160515 A1* 6/2016 Wallance ..... E04F 10/10 52/745.02
2017/0044753 A1* 2/2017 Bowron ..... E04B 1/98
2018/0109163 A1* 4/2018 Paine ..... E04H 5/04
2019/0078321 A1* 3/2019 Bowron ..... E04H 1/005
2019/0148819 A1* 5/2019 Dominguez ..... H05K 5/0247 455/562.1
2019/0153720 A1* 5/2019 Bonlin ..... E04B 1/34317
2019/0234063 A1* 8/2019 Garcia-Abril Ruiz .. E04F 17/08
2020/0362550 A1* 11/2020 Schlagel ..... E04F 11/02
2021/0172164 A1* 6/2021 Holm ..... E05B 63/0065
2022/0069766 A1* 3/2022 Mullings ..... H02S 10/40
2022/0234817 A1* 7/2022 Gunn ..... B65D 88/022
2022/0266065 A1* 8/2022 Stewart ..... A62C 35/60
2022/0306375 A1* 9/2022 Ford, III ..... B65D 88/121
2023/0120060 A1* 4/2023 Stapleton ..... E04B 1/3444 52/79.5
2023/0242303 A1* 8/2023 Tiilikainen ..... B65D 21/086 220/4.34
2024/0295115 A1* 9/2024 Bellissimo ..... E04B 1/34815
2025/0146277 A1* 5/2025 DiCristofaro ..... E04C 2/52

FOREIGN PATENT DOCUMENTS

DE 102012103719 A1 * 10/2013 ..... E04B 1/3483
DE 202020106862 U1 * 12/2020 ..... E04B 1/3483
FR 3030672 A1 * 6/2016 ..... F16L 37/56
MY 179754 A * 11/2020
WO WO-9405879 A1 * 3/1994 ..... E04H 1/005
WO WO-2008027234 A2 * 3/2008 ..... E04B 1/003
WO WO-2010106367 A2 * 9/2010 ..... B65D 90/0026
WO WO-2012045149 A1 * 4/2012 ..... E04B 1/3483
WO WO-2013069971 A1 * 5/2013 ..... E04B 1/348
WO WO-2014053011 A1 * 4/2014 ..... B65D 90/0026
WO WO-2015164975 A1 * 11/2015 ..... F16B 7/185
WO WO-2016009069 A1 * 1/2016 ..... E04B 7/18
WO WO-2017027965 A1 * 2/2017 ..... E04B 1/38
WO WO-2017185125 A1 * 11/2017 ..... E04H 1/005
WO WO-2018101891 A1 * 6/2018 ..... E04B 1/3483
WO WO-2019059846 A2 * 3/2019 ..... E04B 1/34336
WO WO-2021099593 A1 * 5/2021 ..... E04B 1/34838
WO WO-2022016291 A1 * 1/2022 ..... E04B 1/34869
WO WO-2025008328 A1 * 1/2025 ..... E04B 1/3421

* cited by examiner

105

107

107

ALIGNMENT AND CONNECTION SYSTEM FOR PREFABRICATED MODULAR BUILDINGS

CROSS REFERENCE TO RELATED APPLICATIONS

This application claims the benefit of, and priority to, U.S. Provisional Application No. 63/288,626, filed Dec. 12, 2021, which is incorporated by reference in its entirety.

TECHNICAL FIELD

The disclosure generally relates to connecting volumetric modules together, including structure, utilities and finishes in the field of modular construction, for example, of multi-story buildings.

BACKGROUND

Prefabricated construction is an emerging form of construction. Large portions of buildings are built in a factory offsite and shipped to the jobsite for assembly. Within the world of prefabrication there are two common types of approaches, known as volumetric modular and panelized. Volumetric modular is where prefabricated elements are assembled into 3-dimensional structures that are then shipped to the job site, while panelized is where prefabricated elements are shipped flat and assembled to 3-dimensions at the job site. The goal of using prefabrication is to provide some savings on construction costs. Volumetric modular does this by reducing the amount of local labor while panelized does this by reducing local labor less but reducing transportation relatively more.

The most common form of prefabricated construction today is within volumetric modular and typically includes wood stick-framing, metal stud framing or steel post and beam framing, to build hotels or apartment buildings. In this form of construction, each module usually comprises an occupied room portion and an unoccupied corridor portion. The occupied room portions are finished in the factory and are expected to have minimal work required on the job site. However, the unoccupied corridor portion of each module is incomplete and expected to require more work on the job site. That onsite work includes structural connections, running utility lines to rooms, interior finish-work, and exterior finish-work.

The current method of connecting modules together on the job site involves lifting the modules up with a crane and aligning them with a crew holding taglines as the crane sets the module down in place. Oftentimes, there is no formal alignment system in place, rather the crew uses makeshift elements to get the modules to align with each other. After the modules are placed, conventional clips and nails are used to structurally connect the modules together along the outer rim joists of each module. The result is that modules are expected to be misaligned up to an inch or more in their final resting position. The expected misalignment causes utility lines and finish-work to be done onsite rather than in the factory and why prefabricated construction is not advantageous compared with more conventional forms of construction when it comes to further cost savings or significant improvements in final assembly times.

SUMMARY

Disclosed is a system that includes alignment pins to align modules accurately during the stacking process and steel plates to structurally connect modules together. Further, a system within the module shaft comprises an alignment pin connected to a plate provides a template for each utility riser and ensures coaxial alignment between risers of each module during stacking. In addition, a system on the exteriors of the building waterproofs and hides the matelines of the modules and allows for most of the façade finish-work to be done in the factory.

BRIEF DESCRIPTION OF DRAWINGS

The disclosed embodiments have other advantages and features which will be more readily apparent from the detailed description, the appended claims, and the accompanying figures (or drawings). A brief introduction of the figures is below.

DETAILED DESCRIPTION

Figure 1A:
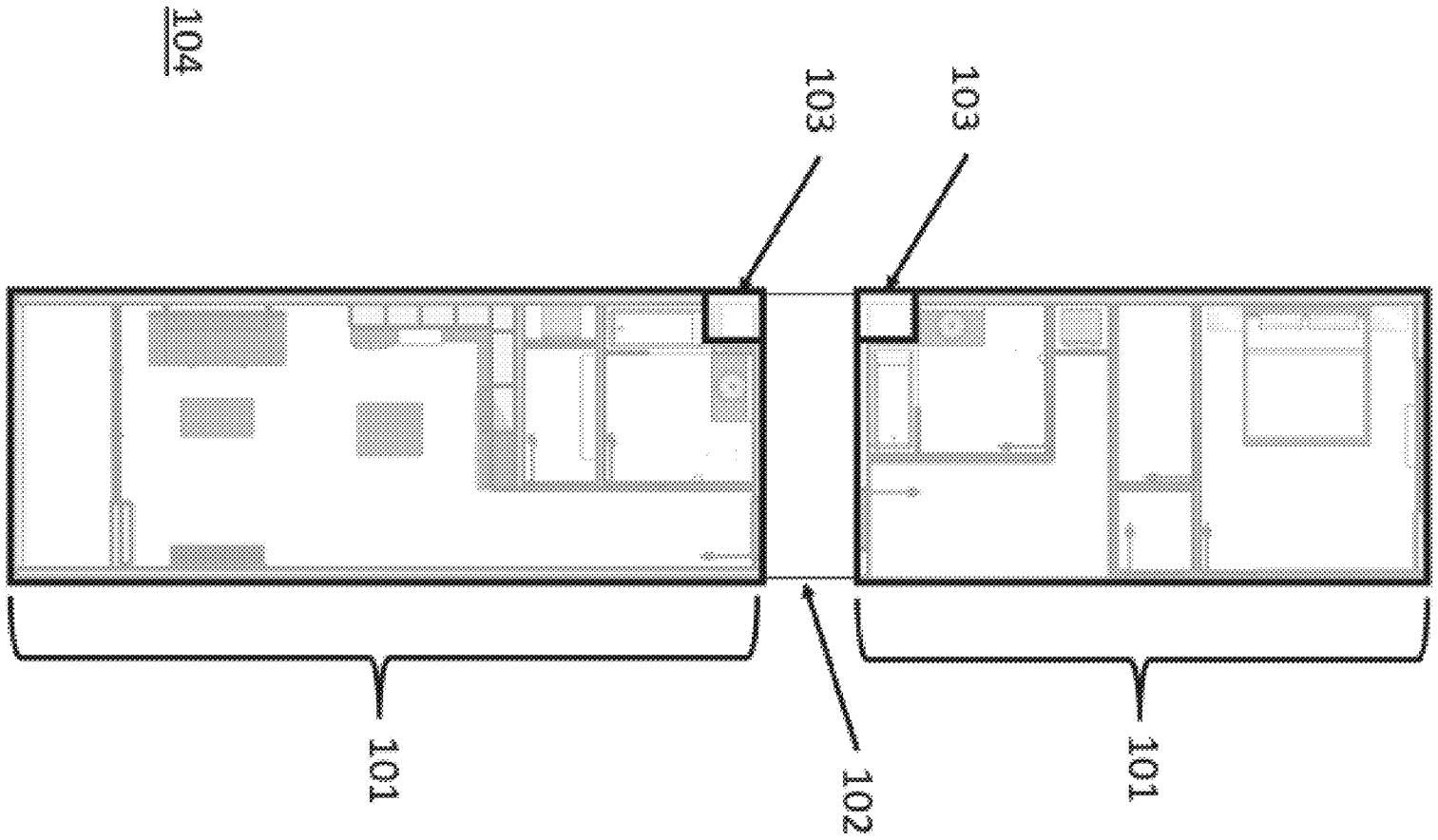
FIG. 1A illustrates an example overview image of a floor plan in accordance with one embodiment.

The Figures (FIGS.) and the following description relate to preferred embodiments by way of illustration only. It should be noted that from the following discussion, alternative embodiments of the structures and methods disclosed herein will be readily recognized as viable alternatives that may be employed without departing from the principles of what is claimed.

Reference will now be made in detail to several embodiments, examples of which are illustrated in the accompanying figures. It is noted that wherever practicable similar or like reference numbers may be used in the figures and may indicate similar or like functionality. The figures depict embodiments of the disclosed system (or method) for purposes of illustration only. One skilled in the art will readily recognize from the following description that alternative embodiments of the structures and methods illustrated herein may be employed without departing from the principles described herein.

Configuration Overview

A "module" (or "construction module" or "housing module") may be a manufactured volumetric space, or housing, that may include at least one room unit. By way of example, a room unit may be a bedroom, a living room, a bathroom, and/or a kitchen. A room unit also may have an unoccupied space meant for public use such as a corridor or common area.

A "riser" may be a utility line such as a pipe or wire for plumbing or electrical that runs vertically from module to module, typically within a shaft. A "run" may be a utility line such as a pipe or wire for plumbing or electrical that runs horizontally from module to module, typically above a drop ceiling within the corridor. A run also may be mechanical ducts, e.g., for a heating, ventilation, air conditioning (HVAC) system or fire sprinkler pipes. A "shaft" may be an empty space within a module that allows risers to run vertically between stacked modules.

"Pre-installed" describes installation within a module in a factory before it is brought onsite. "Offsite" describes the factory where the module is manufactured. "Onsite" means the jobsite or construction site where the module will be set into its final permanent position.

"Stacking" may refer to the act of placing modules on top of or next to each other by a crane at the construction site. "Mateline" may refer to the points where discrete modules connect to each other and can be horizontal or vertical. "Exterior alignment system" may refer to the features that align and connect the exterior face of a module to another module above or below. "Shaft alignment system" may refer to the features that align and connect the shaft of a module to another module above or below. "Onsite finish plate" may refer to the features that allow for a plate to bolt onto the exterior face of modules to waterproof and hide matelines between modules.

Various embodiments of the disclosed configuration provide improved an alignment between modules during the process of stacking them into a modular building. Such stacking typically occurs at a building site ("onsite") on which the modular building will be used for potentially an extended period of time. In conventional assembly of modules, it is not unusual to find modules that have been stacked inches out of alignment and later finishing work must address alignment tolerances on this order (inches). The lax tolerances causes increased onsite work resulting in delays for completing an assembly. The conventional modules are not prefabricated for tolerance sensitive tasks such as utility risers and runs or interior and exterior finishes because of this misalignment issue. Preassembly may cause added costs and further delays as preassembled units often has to be removed and reassembled to account for the misalignment.

The disclosed alignment systems and methods ensure that key parts of modules are in alignment to a much tighter level of tolerance. For example, long walls along the exterior of each module and the interior corridor walls, both of which are often used as structural shear walls, may be aligned within less than ½ or ¼ inch. Finally, in some embodiments, the alignment system improves alignment of corridor shafts, which allows for the pre-installation of risers and runs, again reducing the scope of onsite work.

Various embodiments of the disclosed configuration also include improved structural connections between those modules that are important for the structural stability of the building. Previously, modules were typically structurally connected using nails and clips that ranged from 6 inches to 24 inches in spacing along the entire length of each wall. In comparison, the connection systems discussed herein includes central locations where fasteners are used in a connection plate attached to the alignment system. This allows for reduced onsite installation because workers require less time to do structural connections as well as patching of floor and wall finishes required to cover the nails and clips mentioned.

In addition, various embodiments of the disclosed configuration improve utility connections due to the improved alignment of the corridor walls and shafts where the utility risers and runs typically live. This means that the onsite scope of utilities reduces from installing the entire systems onsite to connecting pre-installed risers and runs together.

Various embodiments of the disclosed configuration reduce interior finish work because, when the risers and runs can be pre-installed due to the improved alignment between modules, interior finishes can be moved into the factory as well. In today's form of modular construction, the entire corridor interiors are left unfinished with the sheetrock left for onsite install. In some embodiments, corridors are finished with sheetrock in the factory except for locations near the matelines or at shafts, reducing the onsite scope to patching interior matelines and shaft walls.

Further, various embodiments of the disclosed configuration reduce exterior finish work because the exterior finish plate system allows the exterior façade of each module to be pre-installed. In prior forms of modular construction, exterior finish work is done completely onsite in order to hide misalignment between modules with a layer of finish material to cover imperfections. The onsite finish plate of various embodiments is configured to hide matelines and any small misalignments, reducing the scope of onsite work to snapping on finish plates at matelines.

Example Housing Module

FIG. 1A illustrates an example floor plan of an exemplary module (or housing module) 104 in accordance with one embodiment. In this example, the module 104 includes an occupied room area 101, a corridor 102, and a shaft 103. By way of example, a module 104 may have a length of approximately 10 feet to 80 feet, a width of 8 to 30 feet, and a height of 8 feet to 15 feet. The dimensions allow for creating one or more separated rooms as well as corridor space between two or more rooms.

The occupied room area 101 may include a bathroom, kitchen, or living room. The occupied room area 101 may be configured to rent out to a tenant when the space is leased and accordingly, may include a separate entrance way (not shown) along an exterior wall of the module 104. The shaft 103 is a vertical space that spans between modules and is where utility risers are located to connect plumbing, electrical, and HVAC (heating, ventilation, air conditioning) systems. The corridor 102 is where utility runs live within the ceiling (e.g., in a cap module (not shown)) and where people travel throughout the building. The corridor 102 had a width less than the length of the module 104 and a length that may run a width of the module 104.

Figure 1B:
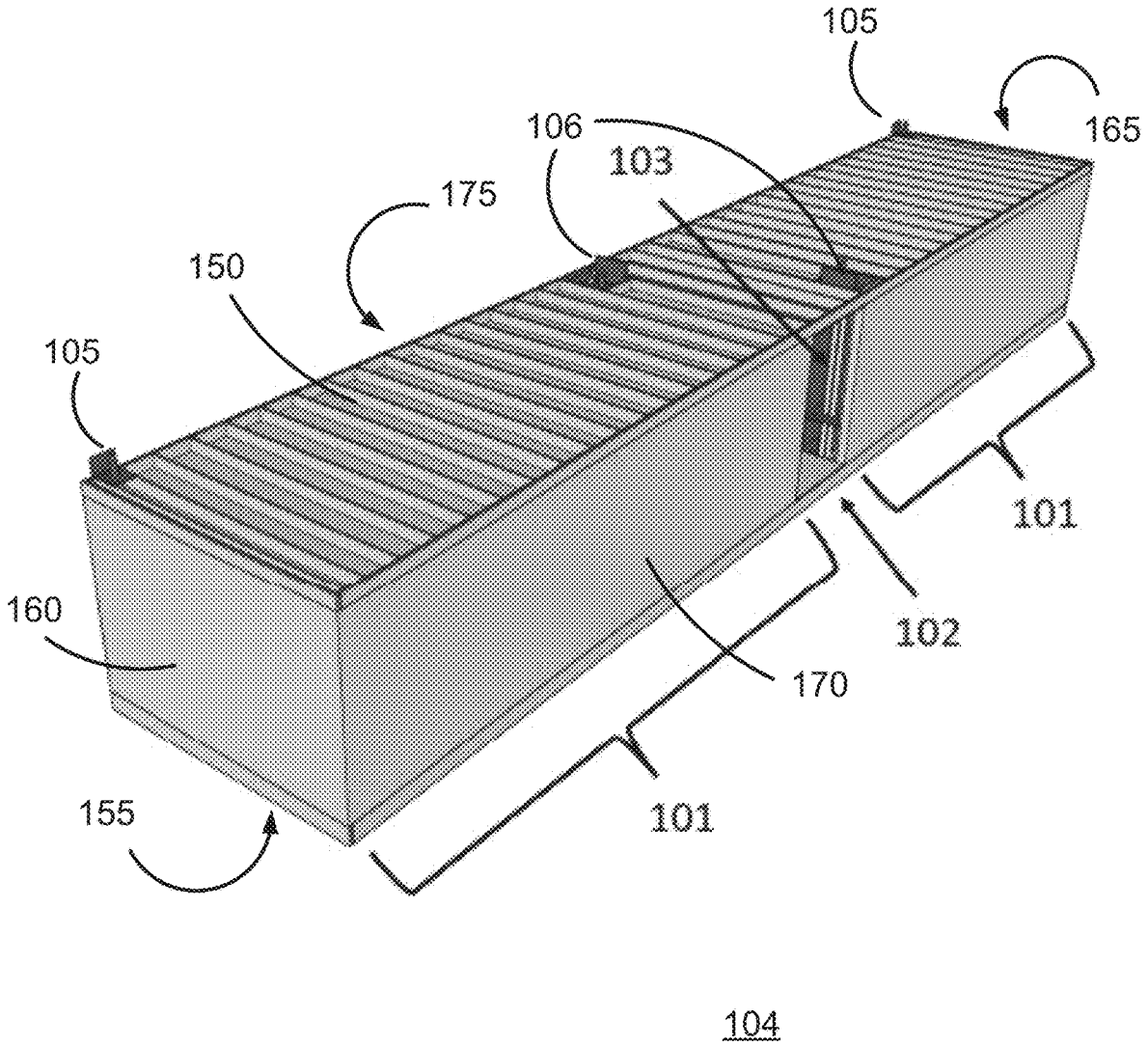
FIG. 1B: illustrates an example of a housing module in accordance with one embodiment.

FIG. 1B illustrates an isometric view of the module 104 in accordance with one embodiment. The module 104 includes a top 150, a bottom 155, a first end 160 and a second end 165, a first long exterior wall 170, and a second long exterior wall 175. The ends 160, 165 may be along a width side and the walls 170, 175 along a length side of the module 104. In this example, along at least the first long exterior wall 170 may the corridor 102. The corridor may pass through to the second long exterior wall 175. Within the corridor is the shaft 103. In this example, the top 150 of the module 104 includes one or more exterior wall alignment systems (or element(s)) 105 and one or more interior (shaft) alignment systems (or element(s)) 106.

The top 150, the first end 160 and the first long exterior wall 170 and the second long exterior wall 175 may provide a portion of the boundary for the occupied room area 104. The corridor 102 or the second end 160 may provide another portion for the occupied room area 101 of the module 104. If the corridor provides the other portion of the occupied room area 101, the second end 165 may provide a boundary for a second occupied room area 101.

Figure 1C:
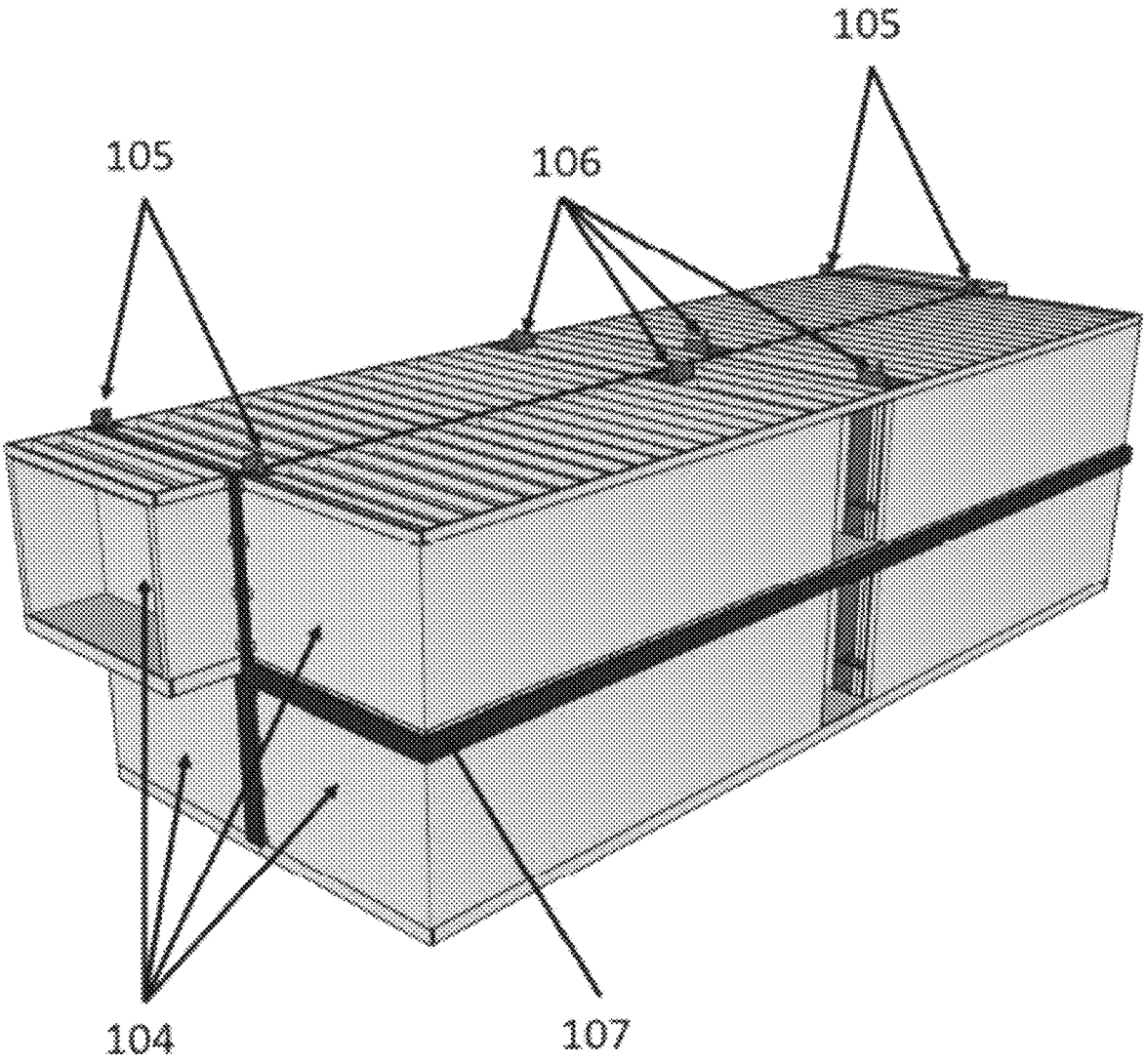
FIG. 1C: illustrates an example of two or more housing modules in accordance with one embodiment.

FIG. 1C shows multiple modules 104 stacked to create a multistory construction assembly that may be used for housing. The multi-story construction assembly includes two or more housing modules that may be a assembled on a construction site. The assembly may occur using a crane to lift and set modules 104 that are placed on a foundation and stacked one on top of another.

The exterior wall, or exterior, alignment system 105, the shaft, or interior, alignment system 106, and the exterior finish system 107 are shown. The exterior wall alignment system 105 is configured to align horizontally and vertically with the long exterior walls 170, 175 of the module 104. The horizontal and vertical alignment allows alignment of two or more modules 104 (e.g., 104*a-n*) stacked on top of each other, e.g., as further described below in FIGS. 5-8. The shaft alignment system 106 is configured to align and connect the interior corridor walls of the module and are meant to focus specifically on aligning the risers within the shafts. The exterior finish system 107 waterproofs and hides the mateline between modules.

Figure 2:
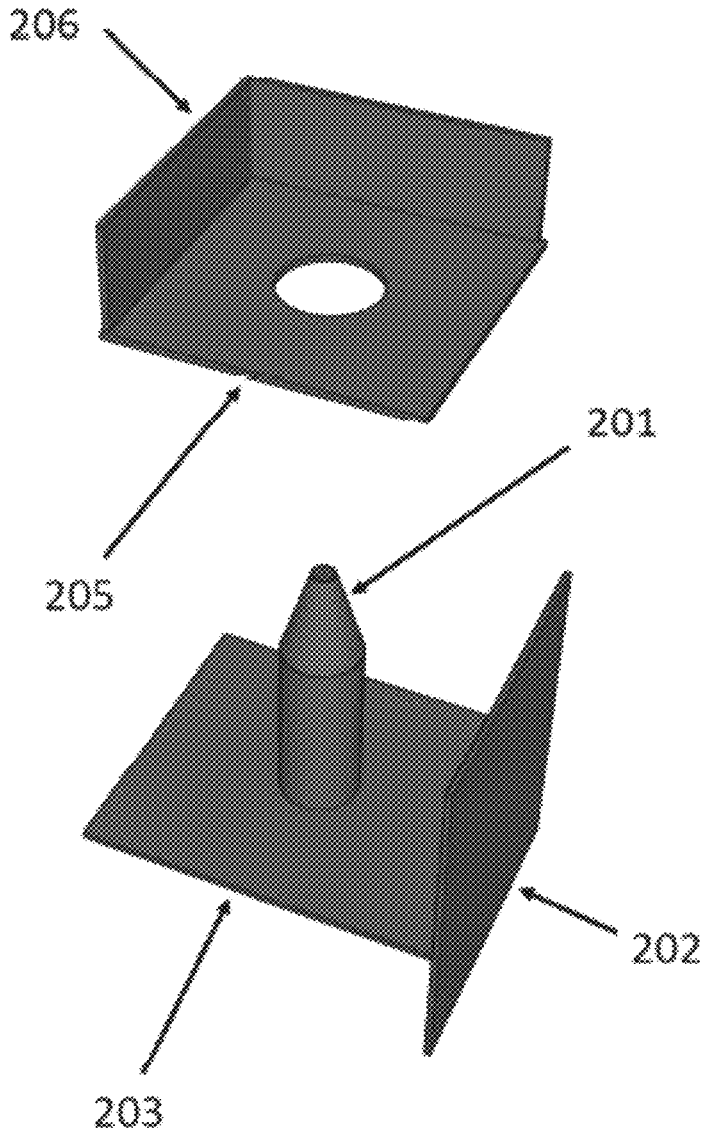
FIG. 2: illustrates an example of an exterior alignment system in accordance with one embodiment.
Figure 3:
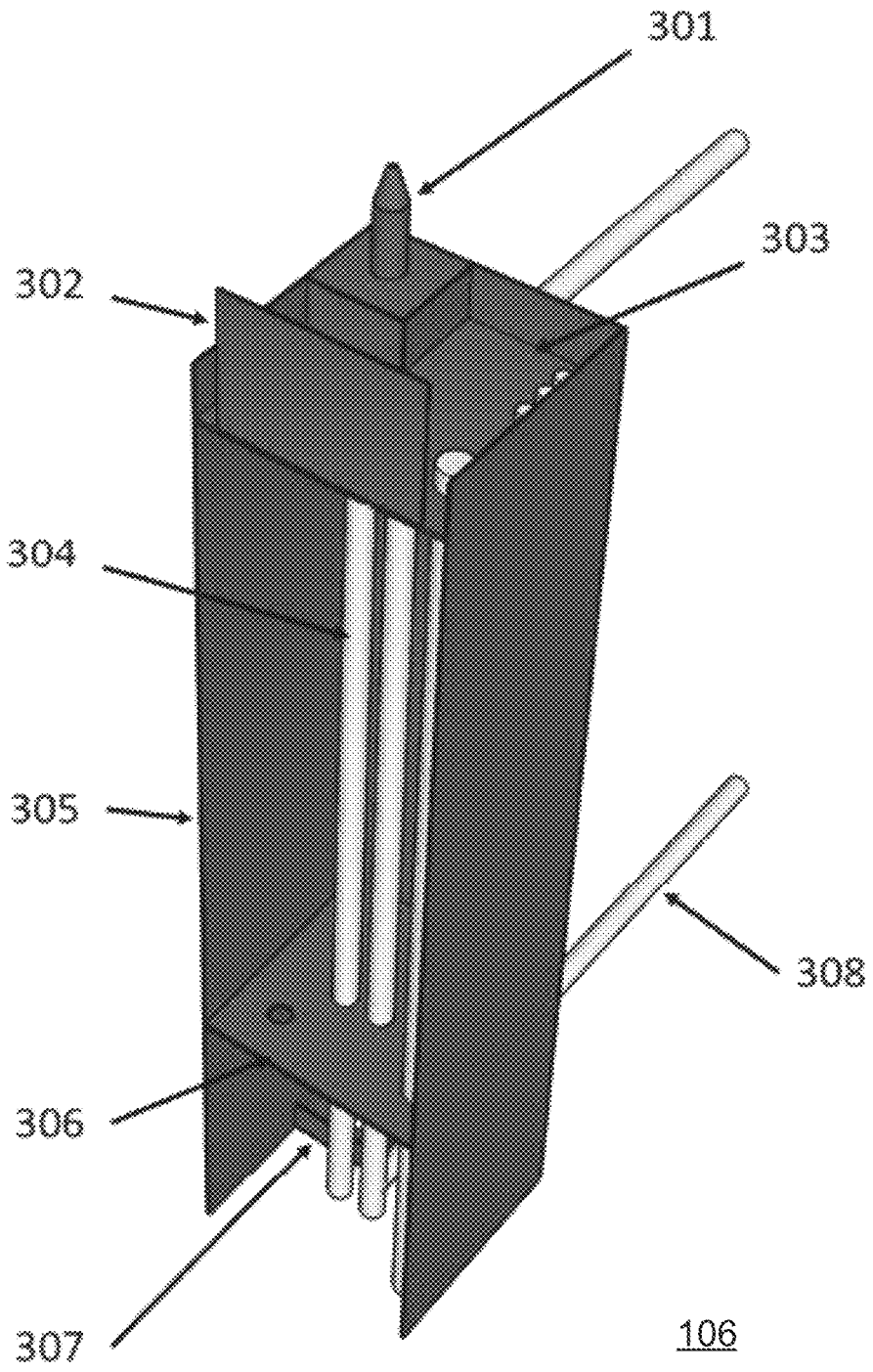
FIG. 3: illustrates an example of a shaft alignment system in accordance with one embodiment.

Referring to FIGS. 2 and 3, FIG. 2 illustrates alignment of exterior walls of two or more stacked modules 104. FIG. 3 illustrates alignment of shafts of a module 104 so that shafts of two or more modules 104 align together. The configuration provides a constrained system where the modules 104 have fixed stability without binding. Moreover, the shear walls of each module 104 along its long exterior walls and the corridor walls provide lateral support for the assembled building comprised of interconnected modules.

Referring now to FIG. 2, illustrated is an example of the exterior wall alignment system 105. The exterior wall alignment system 105 aligns the long exterior walls 170, 175. The exterior wall alignment system 105 comprises a female exterior wall alignment feature 205 and a male exterior wall alignment feature 201. The alignment features 201, 205 have a first set of alignment elements and a second set of alignment elements, the first set of alignment elements being configured to engage prior to engagement of the second alignment elements and the first alignment elements having a courser alignment precision than the second alignment elements. For example, the female exterior wall alignment feature 205 includes an opening that interfaces with the male alignment feature 201 having an extruding (e.g., protruding) piece that may or may not taper and may be fabricated with forged steel or plates in a cross pattern like an arrowhead. Further by example, the male exterior wall alignment feature 201 extruding piece may be a pin and the female exterior wall alignment feature 205 opening may be a receiver that aligns within ¼ inch in each dimension of a horizontal plane.

The male exterior wall alignment feature 201 is disposed on top of a male plate 203 that is connected (e.g., forged or welded) to a connector plate 202, that is used to connect upper and lower modules together structurally through a series of fasteners that are optionally drilled through. In example one embodiment, the male exterior wall alignment feature 201 is structured for integration along a top 150 of a first module 104, for example, along corners of the top 150 of the first module 104. The female exterior wall alignment feature 205 may be structured for integration along the bottom 155 (e.g., a floor framing system) of a second module 104 in locations reciprocal to the locations of the male alignment feature 201 on the top 150 of the first module 104. For example, exterior wall alignment elements 201, 205 may be configured to align the first and second modules 104 relative to their long exterior walls 170, 175.

As noted, each of the modules 104 further include one or more module exterior wall alignment elements 201, 205 configured to align a first construction module in a horizontal plane relative to a second construction module stacked upon the first construction module. The modules 104 may be configured of wood and/or metal framing and the exterior wall alignment elements 201, 205 may be optionally being fixed to the framing.

The connector plate 202 is designed to connect structural shear walls of the building that act as lateral support, for example, in the event of high-winds or earthquakes according to building codes. Female plates 206 are used to connect the female alignment feature 205 to a floor framing system of each module 104.

The exterior wall alignment features 205, 201 may be disposed along the respective top and bottom of exterior wall alignment system 105 that run from the bottom 155 to the top 150 of a module 104. Within the modules 104, the shaft alignment system 106 may be structured in a location proximate to the corridor section, e.g., between two room sections, or may be structured proximate to locations such as corners of the modules 104.

FIG. 3 illustrates example embodiments of the shaft alignment system 106 and shows different features in more detail. With the exterior walls 170, 175 appropriately aligned per FIG. 2, FIG. aligns the shafts of the modules 104. Together it beneficially provides for a constrained system where the modules 104 are fixed stably without binding. Moreover, the shear walls that act as lateral support for the building reside at the long exterior walls and the corridor walls, as well, so the locations are chosen purposefully.

In FIG. 3, the shaft alignment system 106 (which may incorporate riser structures) may be integrated with the shaft 103 of the housing module 104. The shaft alignment system 106 includes a male riser alignment feature 301, a connector plate 302, an upper template plate 303, one or more utility risers 304, one or more vertical plates 305, a lower template plate 306, a female riser alignment feature 307, and one or more utility horizontals. The upper template plate 303 and lower template plate 306 may include one or more openings, e.g., holes, through which the one or more utility risers 304 may pass through.

The female riser alignment feature 307 includes an opening (not shown) that interfaces with the male riser alignment feature 301. The male riser alignment feature 301 includes an extruded piece that may or may not taper and may be fabricated with forged steel or plates in a cross pattern like an arrowhead and through which passes the opening of the female riser alignment feature of a module, e.g., 104*a*, being placed from above, e.g., by a crane, onto the already fixed below module, e.g., 104*b*. The holes and risers are within ¼, ½ or 1 inch (or any range therebetween) in each dimension of a horizontal plane. The template plate 303 may be created using a computer numerical control (CNC) machine with precise holes to locate the risers relative to the template plate, but also the male alignment feature to the template plate.

The male riser alignment features 301 and the female riser alignment feature 307 are fixed together by being connected vertically. The male riser alignment feature 301 may be attached to the upper template plate 303. The upper template plate 303 includes the holes through which the utility risers

304 pass. Given the holes may be precisely structured, utility risers 304 may be accurately fit and may include sufficient gap between the riser 304 and the hole edge to allow space for some movement that may occur, e.g., through environment activity such as winds or earthquakes. The upper template plate 303 is attached to the lower template plate 306 through vertical plates 305 that align the shaft 103 of each module 104. The vertical plates 305 may be constructed of plywood, OSB, sheet metal or steel.

The shaft alignment system 106 is configured to have at least ¼ inches of slop or tolerance relative to the respective construction module. The riser alignment elements are configured to align (horizontally) with each other within at least ¼ inches. Further, the shaft alignment system 106 may be disposed within a frame of each of the shaft sections of the modules 104. The modular exterior wall alignment features 201, 205 are configured to align the frames of the exterior walls 170, 175 of the modules 104*a*, 104*b* align and the riser alignment features 301, 305 align the shaft alignment system 106 within the modules 104*a, b*. The shaft alignment system 106 further may be configured to be a fire barrier. In some embodiments, the riser alignment elements may be configured to adjust a length and/or position of the risers.

The upper template plate 303 is connected to the connector plate 302. The connector plate 302 connects upper and lower modules, e.g., 104*a* (a first module) and 104*b* (a second module). The modules 104*a*, 104*b* may be structurally coupled together through one or more fasteners, e.g., bolted or riveted through drilled holes. The connector plate 302 may be structured to connect structural shear walls of the building that provides lateral support, e.g., to address building codes for environments that may need to account for external environmental conditions such as high-winds or earthquakes.

The utility risers 304 within the shaft alignment system 106 are conduits and/or pipes, e.g., for utilities and/or HVAC systems. The lines may be directed to the occupied room areas 101 through the utility horizontals 308. Further, a bottom most housing module may include connection points within the foundation or a crawl space that is part of the foundation and to which conduits and/or pipes may couple with services such as electrical, cable, water, sewer utilities, and/or HVAC. In some embodiments, riser connection points may be at a top most housing module for services such as electricity and/or cable utilities and/or HVAC may be coupled with a top most housing module.

The shaft alignment system 106 may be structured to be adjacent to a corridor 102 of a module 104. The shaft alignment system 106 may be configured to be a fire barrier by being encased with a fire retardant material and/or coating. Further the shaft alignment system 106 may be configured to provide height and/or width adjustment to allow appropriate positioning and fit relative to housing modules 104 positioned above and/or below the housing module of to be adjusted shaft alignment system 106.

The male riser alignment features 301 is disposes along a top of the shaft alignment system 106 and the female riser alignment feature 307 is disposed at a bottom of the shaft alignment system 106. It this configuration, the female riser alignment feature 307 of a shaft alignment system of a first housing module 104*a* that is to be placed on an already installed, or second, housing module 104*b* by positioning the female riser alignment feature 307 over and around the male riser alignment feature 301 of a shaft alignment system 106 of the installed housing module 104*b*. The riser alignment features 301, 307 may be configured to have at least ¼ inches of slop relative to the respective housing modules 104*a*, 104*b*. The male riser alignment features 301 and the female riser alignment feature 307 also may be configured to align (horizontally) with each other within at least ¼ inch.

Figure 4A:
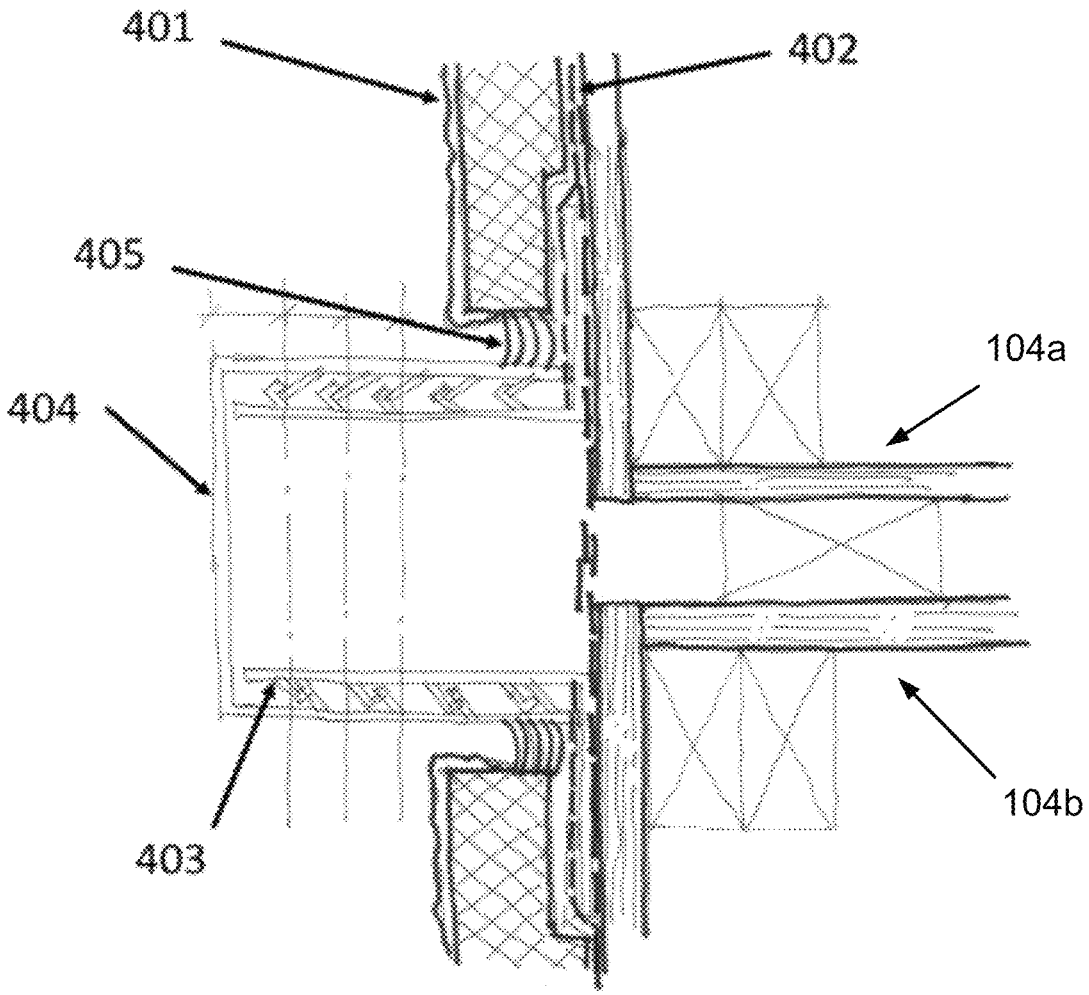
FIG. 4A: illustrates an example of onsite finish plates in an aligned configuration in accordance with one embodiment.

FIG. 4A illustrates the exterior finish system 107 in the case where a first housing module, e.g., housing module 104*a*, may be an upper stacked module that is stacked on top of a second housing module, e.g., housing module 104*b*, that may be a lower stacked module. In this example the upper stacked module 104*a* is aligns with the lower stacked module 104*b*. The exterior finish 401 may be a common finish system used in architecture and is pre-installed up to the steel angle plate 403 that may come in 4 inch to 12 inch lengths. Between the steel angle plate 403 and the exterior finish 401 is waterproofed, for example by caulk 405 or an equivalent method. Beneath the exterior finish 401 and the steel angle plate 403 is a waterproofing membrane 402 that is lapped over the mateline between modules. To provide an aesthetic finish that hides the matelines and acts as a weatherproofing barrier, the bent finish plate 404 is attached onsite. Interface points are shown on the angle plate 403 and the bent finish plate 404 so that when the bent plate 404 is attached onsite, it can be attached without requiring fasteners, making onsite installation simple.

Figure 4B:
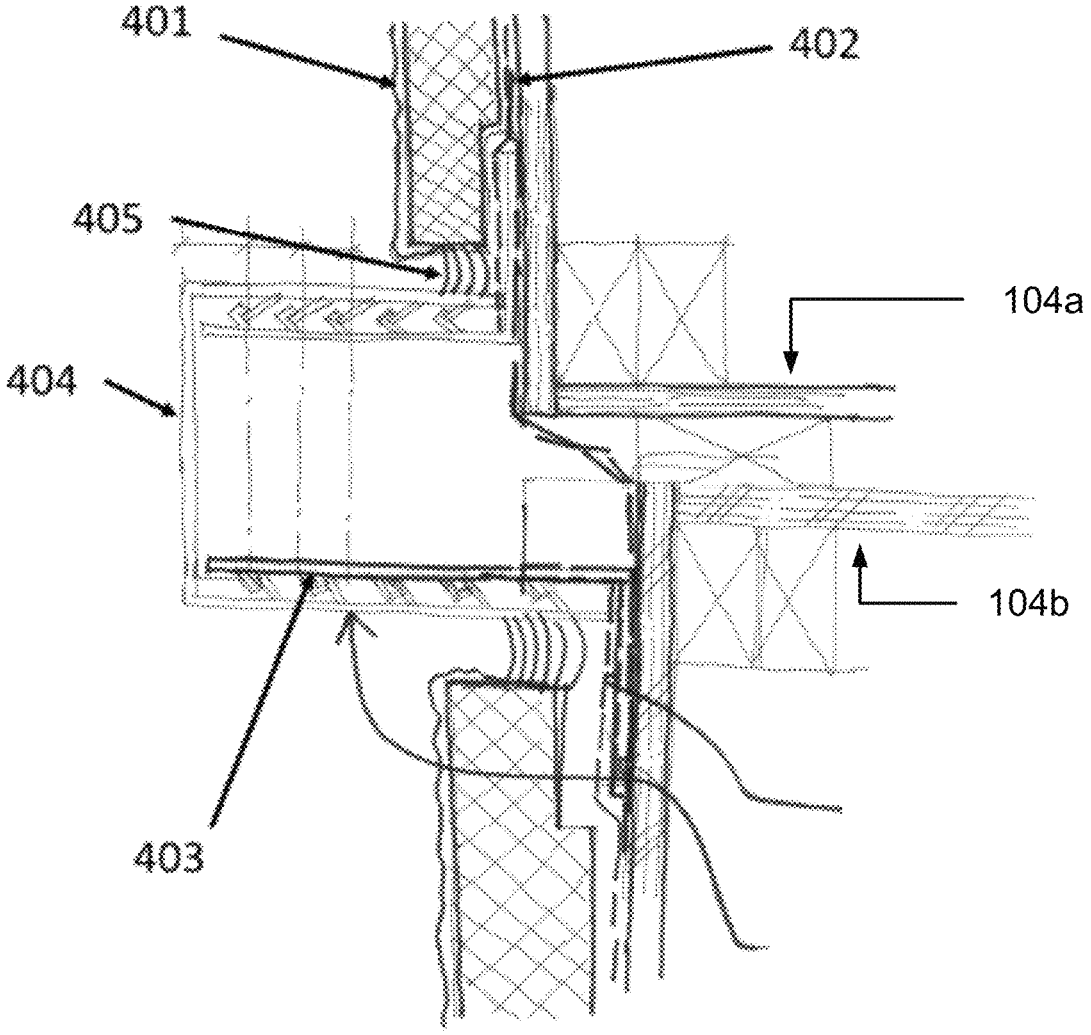
FIG. 4B: illustrates an example of onsite finish plates in a misaligned configuration.

FIG. 4B focuses on the exterior finish system 107 in the case where the upper stacked module 104*a* and the lower stacked modules 104*b* are may be slightly misaligned but still structurally viable. In this configuration, the misalignment may be, for example, in a range of 1/16 inch to 2 inches. In this example, the bent finish plate 404 is modified by trimming the legs of the plate in preset increments of ¼ inch to ensure the bent finish plate 404 can be attached over the misaligned steel angle plates 403. These preset increments of ¼ inch are designed to be cut on the job site to accommodate up to 2 inch misalignment between upper and lower modules 104 and may include cut lines that make trimming the steel angle plates 403 easier. The result of this system is that the misalignment is hidden and the bent finish plate 404 continues to act as a weather barrier.

Figure 5:
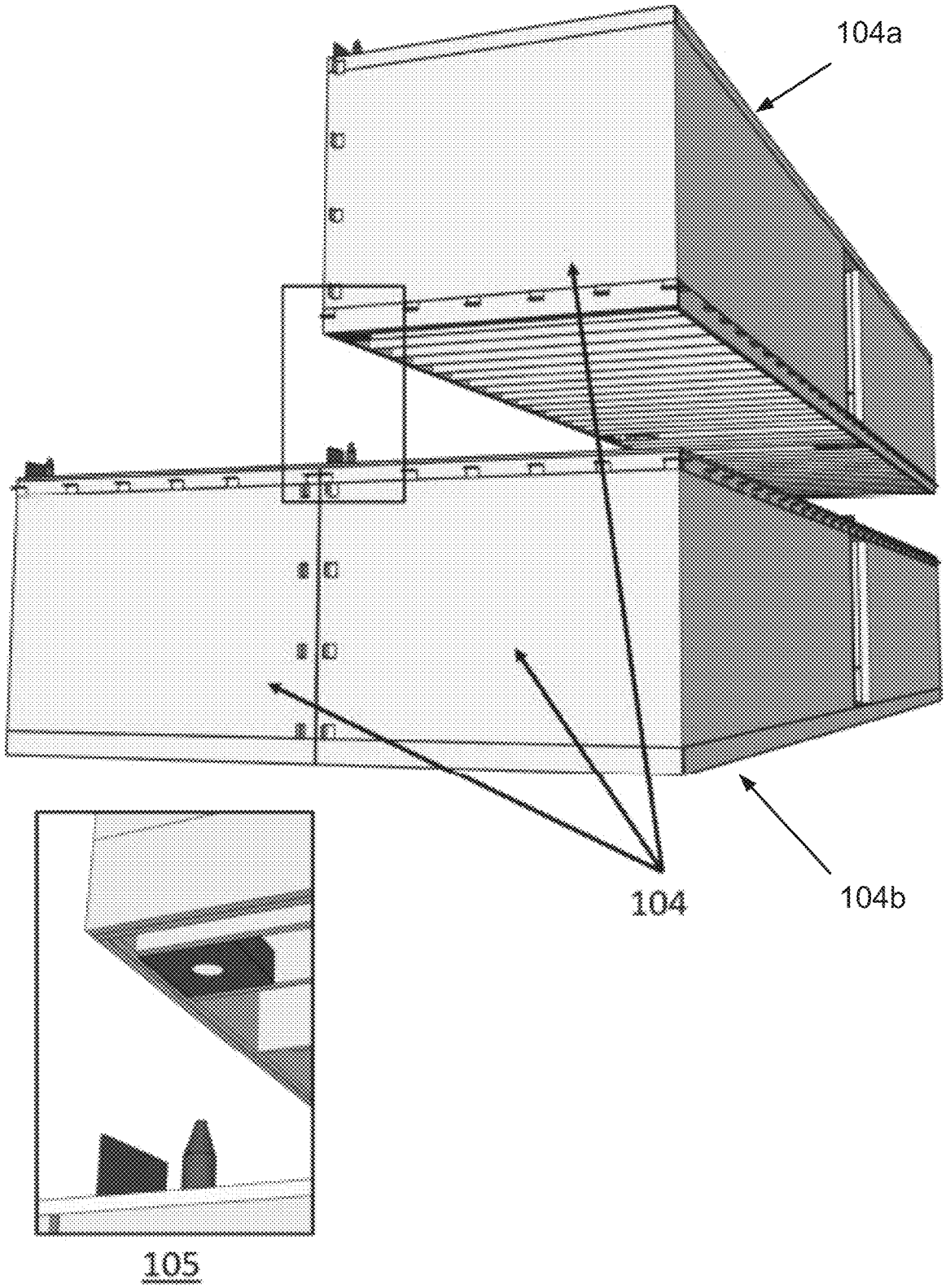
FIG. 5: illustrates an example of a housing module in mid-stack to showcase an exterior alignment system in accordance with one embodiment.

FIG. 5 illustrates an example of housing modules 104 being stacked. In this example, a first housing module, e.g., 104*a*. being stacked onto a lower layer of housing modules, e.g., 104*b*, which already may be installed in place, e.g., secured to a foundation. In this view, the exterior alignment system 105 with the female exterior wall alignment feature 205 is aligned with the male exterior wall alignment feature 201. The first housing module 104*a* may be stacked onto the lower housing module 104*b* using a crane assembly that lowers the upper housing module 104*a* onto the lower housing module 104*b*. In that process, a female exterior wall alignment feature 205 at the bottom of the upper housing module 104*a* is aligned with a male exterior alignment feature 205 at a top of the lower housing module 104*b*. Moreover, a female riser alignment feature 307 of any shaft alignment system 106 of the upper housing module 104*a* is aligned with a corresponding male riser alignment feature 301 of a shaft alignment system 107 of the lower housing modules. As the upper housing module 104*a* is positioned into place the respective hole in the female alignment features 206, 307 of the upper housing module 104*a* is placed over the respective male alignment feature 201, 301 of the lower housing module 104*b* to ensure overall alignment within tolerance levels of the upper housing module 104*a* with the lower housing module 104*b*.

Figure 6:
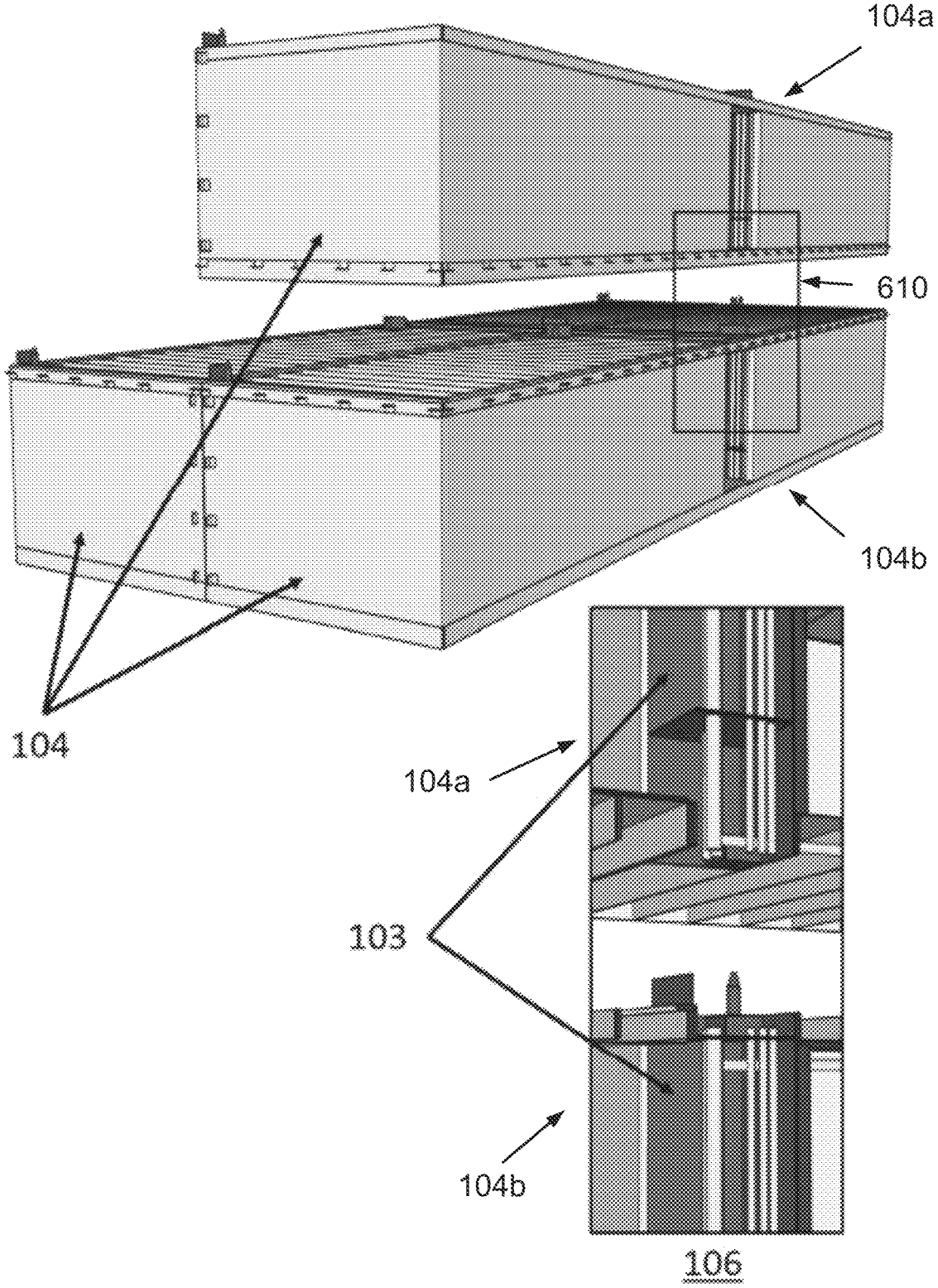
FIG. 6: illustrates an example of housing modules after stack to showcase a shaft alignment system in accordance with one embodiment.

FIG. 6 illustrates an example of the first housing module 104*a* being stacked onto the second housing module 104*b* in which the shaft alignment system 106 aligns the shafts 103 of the housing modules 104*a*, 104*b*. In this view, the shaft alignment system 106 with the female riser alignment feature 307 on the bottom of the upper (or first in this example) housing module 104*a* is illustrated in line with the male riser alignment feature 301 on the top of the bottom (or second in this example) housing module 104*b*. Also shown are the utility risers 304 that will be in line for easy utility installation.

Also shown in FIG. 6 is an area 610 within which a cap module may be installed. A cap module (not shown) may be structured over a corridor 102 of a module 104. The cap module may have dimensions that are the equal to or less than a width of the module 104, a length that may be equal to or slightly beyond the width of a corridor 102 of the module 104. A cap module also may be configured to fit across two or more corridor sections of two or more housing modules. The cap module may include two or more pre-installed runners supported by runner supports. The runners have a length greater than a width of at least two of the housing modules. The cap module includes cap alignment elements configured to align the cap module relative to shaft alignment system 106 connectors 301, 307 of the housing modules 104. The module connectors of the cap module may be structured similar to the connectors 301, 307 of the shaft alignment system 106. Within the cap modules, there may be connectors to pipes or conduits of the housing modules to connect, for example, utilities, plumbing, sewer and/or HVAC among modules 104 at the same planar level, e.g., a same floor in a multi-story housing configuration.

In an example embodiment, the cap module may be configured to fit across the corridor section 102 of a housing module 104. The cap module may include one or more runners. Each runner may have a first end and a second end. Further, each runner may have a length greater than a width of the housing module. The cap module may cap alignment elements configured to align the cap module with the one or more shaft alignment elements of the housing modules. The cap alignment elements may include a female alignment feature, e.g., similar to female alignment feature 205, and a male alignment feature, e.g., similar to male alignment feature 201. The female alignment feature may be along a bottom portion of the runner to interface with the male alignment feature of at the top of a shaft alignment element 106. The male alignment feature may be along a top of the runner to interface with a feature alignment feature at the bottom of shaft alignment system 106 of a housing module that may be positioned on top of the current housing module. A first end if a runner may be configured to couple with a second end of a riser of the one or more risers of the shaft alignment system 106 of the current housing module. A second end of the runner may couple as subsequent source to another runner and/or a riser. It is noted that the "source" may be considered an intake or an outtake for a utility, plumbing, sewer, or HVAC system. For example, a riser source may be a municipal water or electrical system at a base housing module and then that riser is a source for the housing module that is positioned, or stacked, on top of the base housing module.

Figure 7:
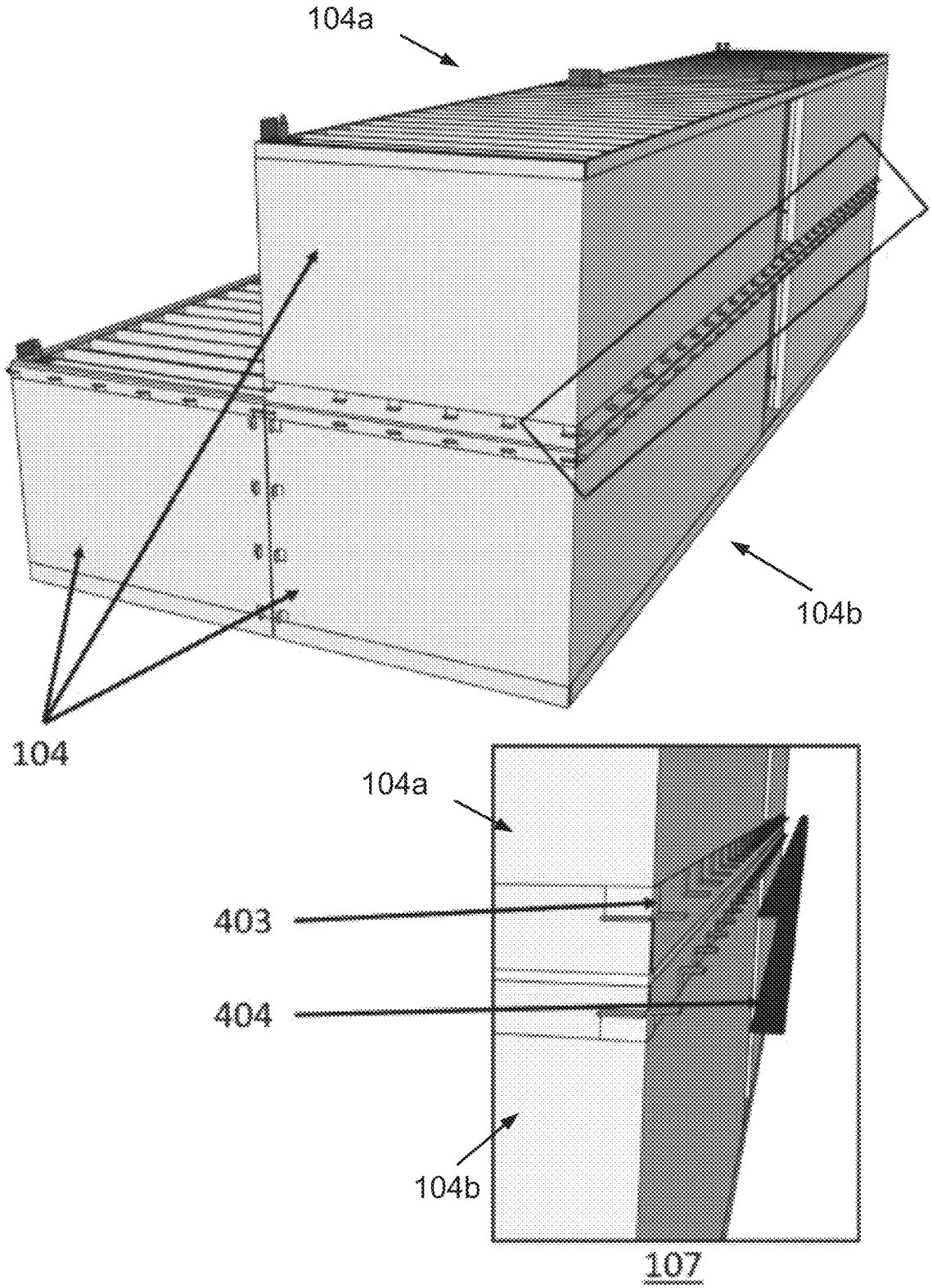
FIG. 7: illustrates an example of housing modules from an exterior to show the onsite finish plates in accordance with one embodiment.

FIG. 7 illustrates the first housing module 104*a* after being stacked into the second housing module 104*b*, but before the exterior finish system 107 is installed. The steel angles 403 are shown pre-installed on the upper and lower modules next to the matelines. In mid-install is the bent plate 404 that attached to the steel angles 403 with a snap-on interface.

Figure 8:
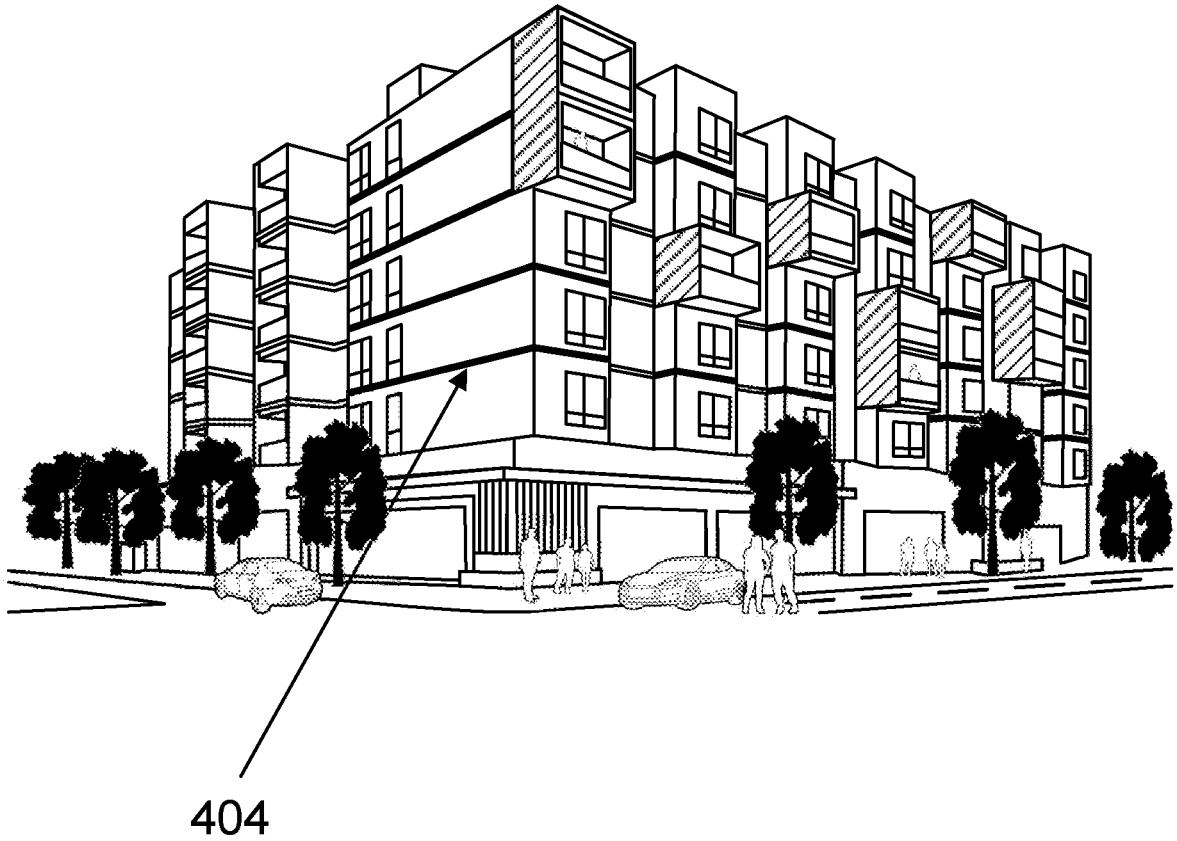
FIG. 8: illustrates an example of a finished building using housing modules in accordance with one embodiment.

FIG. 8 is a rendering of a final exterior of a building according to various embodiments of the invention. The exterior alignment system 105 and the shaft alignment system 106 are hidden after the modules are stacked and finished. The exterior finish system 107 is shown with only the bent plate 404 seen from the outside to hide matelines and make the exterior of the building look finished.

Additional Configuration Considerations

The disclosed configuration enables faster and more efficient assembly of housing assemblies on location at construction sites by quickly aligning modular housing modules for subsequent interior and exterior finishing.

Throughout this specification, plural instances may implement components, operations, or structures described as a single instance. Although individual operations of one or more methods are illustrated and described as separate operations, one or more of the individual operations may be performed concurrently, and nothing requires that the operations be performed in the order illustrated. Structures and functionality presented as separate components in example configurations may be implemented as a combined structure or component. Similarly, structures and functionality presented as a single component may be implemented as separate components. These and other variations, modifications, additions, and improvements fall within the scope of the subject matter herein.

Upon reading this disclosure, those of skill in the art will appreciate still additional alternative structural and functional designs for a system and a process for an alignment and connection system for prefabricated modular buildings through the disclosed principles herein. Thus, while particular embodiments and applications have been illustrated and described, it is to be understood that the disclosed embodiments are not limited to the precise construction and components disclosed herein. Various modifications, changes and variations, which will be apparent to those skilled in the art, may be made in the arrangement, operation and details of the method and apparatus disclosed herein without departing from the spirit and scope defined in the appended claims.

What is claimed is:

1. A modular construction system comprising:

a plurality of housing modules configured to vertically stack upon each other to create a multi-story construction assembly, each of the plurality of housing modules including at least a room section, a shaft section and a corridor section, each housing module having a bottom and a top;

one or more exterior wall alignment elements, each exterior wall alignment element having a top and a bottom, a male exterior wall alignment feature structured along the top and a female exterior wall alignment feature structured along the bottom; and one or more shaft alignment elements, each shaft alignment element having a top and a bottom, a male riser alignment feature structured along the top, and a female riser alignment feature structured along the bottom, and having an upper template plate structured in proximity with the top and with one or more riser openings, and a lower template plate structured in proximity with the bottom with one or more riser openings, the one or more riser openings of the upper template plate vertically aligned with the one or more riser openings of the lower template plate;

one or more risers configured to pass through corresponding one of more riser openings of the lower template plate and the upper template plate, each riser of the one or more risers having a first end and a second end, the first end of each riser structured to couple a source; and a cap module configured to fit across the corridor section, the cap module including one or more runners, each runner having a first end and a second end and having a length greater than a width of a housing module of the plurality of housing modules, the cap module including cap alignment elements configured to align the cap module with the one or more shaft alignment elements of the plurality of housing modules, the first end of a runner configured to couple the second end of a riser of the one or more risers and a second end of the runner coupled as subsequent source.

2. The modular construction system of claim 1, wherein the one or more risers disposed within the one or more riser openings are positioned to within plus or minus one of ⅛ inch to 1 in each dimension of a horizontal plane.

3. The modular construction system of claim 1, wherein each of the plurality of housing modules further include one or more module alignment elements configured to align a first housing module in a horizontal plane relative to a second housing module stacked upon the first housing module.

4. The modular construction system of claim 3, wherein the one or more module alignment elements are configured to align a first housing module and a second housing module relative to one of a shaft section of the first housing module and a shaft section of the second housing module or first alignment feature of the first housing module and a reciprocal alignment feature of the second housing module.

5. The modular construction system of claim 4, the first alignment feature comprises a male alignment feature and the reciprocal alignment feature is a female alignment feature.

6. The modular construction system of claim 5, wherein the male alignment feature is along a top of the first housing module and the female alignment feature is along a bottom of the second housing module.

7. The modular construction system of claim 4, wherein the cap alignment elements comprises a male alignment feature and the reciprocal alignment feature is a female alignment feature.

8. The modular construction system of claim 1, wherein a shaft alignment element of the one or more shaft alignment elements includes an upper connector plate and a lower connector plate.

9. The modular construction system of claim 8, wherein the upper connector plate includes a riser opening and the lower connector plate includes a riser opening, the riser opening of the upper connector plate aligned with the riser opening of the lower connector plate.

10. The modular construction system of claim 9, wherein a shaft alignment element of the one or more shaft alignment elements includes a male alignment feature along a top of the shaft alignment element and a female alignment feature along a bottom of the shaft alignment element.

* * * * *